US012221857B2

(12) United States Patent
Talapatra et al.

(10) Patent No.: US 12,221,857 B2
(45) Date of Patent: Feb. 11, 2025

(54) GAS-ACTUATED DUMP BAILER

(71) Applicant: BiSN Tec Ltd., Warrington (GB)

(72) Inventors: Didhiti Talapatra, Houston, TX (US); Bobby Chancellor, Houston, TX (US); Matthew Naylor, Houston, TX (US)

(73) Assignee: BiSN Tec Ltd., Cheshire (GB)

( * ) Notice: Subject to any disclaimer, the term of this patent is extended or adjusted under 35 U.S.C. 154(b) by 336 days.

(21) Appl. No.: 17/985,585

(22) Filed: Nov. 11, 2022

(65) Prior Publication Data

US 2024/0159126 A1 May 16, 2024

(30) Foreign Application Priority Data

Nov. 12, 2021 (GB) ..... 2116384

(51) Int. Cl.

| | |
|---|---|
| ***E21B 27/02*** | (2006.01) |
| ***E21B 29/02*** | (2006.01) |
| ***E21B 33/12*** | (2006.01) |
| ***E21B 33/13*** | (2006.01) |
| ***E21B 34/14*** | (2006.01) |
| ***E21B 36/00*** | (2006.01) |

(52) U.S. Cl.

CPC ..... *E21B 34/14* (2013.01); *E21B 27/02* (2013.01); *E21B 29/02* (2013.01); *E21B 33/1204* (2013.01); *E21B 33/13* (2013.01); *E21B 36/008* (2013.01)

(58) Field of Classification Search

CPC ..... E21B 36/00; E21B 36/04; E21B 36/02; E21B 36/008; E21B 29/02; E21B 27/02

See application file for complete search history.

(56) References Cited

U.S. PATENT DOCUMENTS

| | | | | |
|---|---|---|---|---|
| 1,330,023 | A * | 2/1920 | Hardel | E21B 33/14 166/69 |
| 1,449,672 | A * | 3/1923 | Hallvarson | E21B 27/02 166/63 |
| 2,915,125 | A * | 12/1959 | Hanes | E21B 27/00 166/99 |
| 3,463,248 | A * | 8/1969 | Bell | E21B 43/116 166/162 |
| 4,739,829 | A * | 4/1988 | Brunner | E21B 27/02 166/63 |
| 12,110,759 | B2 * | 10/2024 | Marques Pires | E21B 33/1208 |
| 12,129,735 | B2 * | 10/2024 | Hearn | E21B 29/02 |
| 2003/0051870 | A1 * | 3/2003 | Robertson | E21B 29/02 166/55.7 |
| 2011/0174484 | A1 | 7/2011 | Wright et al. | |
| 2012/0247755 | A1 | 10/2012 | Colon et al. | |
| 2015/0345248 | A1 * | 12/2015 | Carragher | C06B 33/00 166/57 |
| 2016/0319633 | A1 * | 11/2016 | Cooper | E21B 34/142 |
| 2019/0085659 | A1 * | 3/2019 | Carragher | E21B 33/1208 |
| 2019/0186233 | A1 * | 6/2019 | Shafer | E21B 33/13 |

(Continued)

FOREIGN PATENT DOCUMENTS

WO WO 2014/096858 6/2014

*Primary Examiner* — Kipp C Wallace

(57) ABSTRACT

A gas-actuated dump bailer tool that can be opened/closed under the direct or indirect action of gas generated by a gas-generating chemical reaction mixture housed within the dump bailer. Additionally, a downhole tool assembly that employs the dump bailer together associated methods of using the dump bailer downhole in an oil/gas well.

25 Claims, 4 Drawing Sheets

(56) References Cited

U.S. PATENT DOCUMENTS

| | | | | |
|---|---|---|---|---|
| 2020/0332620 | A1* | 10/2020 | Carragher | E21B 33/13 |
| 2021/0140255 | A1 | 5/2021 | Creci et al. | |
| 2023/0139705 | A1* | 5/2023 | Abdollahi | E21B 27/02<br>175/40 |

* cited by examiner

GAS-ACTUATED DUMP BAILER

CROSS-REFERENCE TO RELATED APPLICATION

This application claims benefit to UK Patent Application No. 2116384.5, filed Nov. 12, 2021.

FIELD OF THE INVENTION

The present invention relates to downhole tool for use in downhole environments, such as oil and gas wells, and in particular dump bailer tools used to deploy a payload into a downhole target region.

BACKGROUND OF THE INVENTION

Dump bailer are tools employed in downhole operations within oil and gas wells. Dump bailers, which may be run downhole using a variety of deliver support means (e.g. wireline, slickline, coiled tubing), are generally used to either deliver materials (i.e. payload) to a downhole target region or to recovery materials (e.g. fluid and/or debris, such as sand, or waste generated by perforating, milling, drilling operations) from a downhole target region.

In the past, dump bailers have been used to deliver a range of payload materials downhole to carry out a range of operations. Examples of materials that are typically deployed downhole by way of a dump bailer include drilling mud, sand and gravel, and also chemical treatments that help to breakdown paraffin and other flow reducing deposits that might accumulate within an oil/gas well.

Other payload materials, such as cement and resin, are deployed by dump bailers when forming plugs and seals within oil/gas wells. This generally takes place during well completion and well abandonment operations.

Also, in more recent times dump bailer tools have been employed to deliver alloys that are used to form alloy seals and plugs within the target region of an oil/gas well. International PCT application WO2014/096858 describes a dump bailer that is employed in the delivery of an alloy downhole in a well plugging operation.

A dump bailer tool essentially comprises a tubular chamber, within which is loaded the payload material (e.g. cement or alloy), and a discharge port through which the payload material can be discharged into the downhole target region. Closure means may also be provided to block the discharge port until such time as the payload material is to be deployed.

Upon receipt of an activation signal, the closure means can be operated to reveal the discharge port and allow the payload material to be deployed. The operation of the closure means can be carried out is a number of ways depending on whether or not the delivery support used to lower the dump bailer downhole allow for the transmission of signals.

By way of an example, in the cases where a wireline is used as the delivery support, an electrical signal can be used to initiate a means or mechanism to open and/or close the dump bailer. Alternatively, in situations where a signal cannot be transferred to the dump bailer via the delivery support, a simple timer can be employed to open and/or close the dump bailer.

SUMMARY OF THE INVENTION

The present invention relates to a dump bailer with an alternative operation mechanism that is actuated by gas generated by a chemical reaction of chemical mixture housed within the dump bailer. In this regard, the present invention provides a dump bailer in accordance with claim 1.

In this regard the present invention provides a gas-actuated dump bailer for use in the delivery of a payload material to a downhole target region, said dump bailer comprising: an elongate payload chamber having a discharge port, via which the contents of the chamber can be deployed into said target region under the force of gravity; a sleeve that is mounted relative to the payload chamber so as to be moveable between a closed position, in which said discharge port is covered by the sleeve, and an open position, in which said discharge port is exposed by the sleeve; a sleeve actuation mechanism arranged to move the sleeve between the open and closed positions by the action of a piston that is linked, either directly or indirectly, to said sleeve, wherein said mechanism comprises a sealed chamber containing a gas-generating chemical reaction mixture; and wherein the sealed chamber has a pressure port that is configured to eject a focused stream of gas that operates the piston and moves the sleeve between the closed position and the open position.

Preferably the sleeve may have a corresponding port that aligns with the discharge port of the elongate payload chamber when the sleeve is in the open position.

Preferably the elongate payload chamber may be tubular-shaped. In this regard the chamber may have a variety of preferred cross-sections, which include circular, oval and polygonal (e.g. hexagonal).

Preferably the sleeve may be slidably mounted relative to the payload chamber. With that said, it is envisaged that a ported sleeve may also be rotated between the closed and open positions.

It is envisaged that the piston operated by the focused stream of gas ejected from the sealed chamber of the sleeve actuation mechanism may act directly on the sleeve. As such, the piston may be mechanically linked to the sleeve so that the movement of the piston is directly translated to a movement of the sleeve.

Alternatively the piston operated by the focused stream of gas ejected from the sealed chamber may act on the sleeve indirectly via an intermediate mechanism.

To this end, the intermediate mechanism may comprise a mechanical potential energy store in the form of resilient biasing means held in an elastically deformed state by a latch mechanism; and whereby the piston operated by the focused stream of gas frees the latch mechanism and releases the resilient biasing means, which act to move the sleeve between the closed position and the open position.

It is envisaged that the resilient biasing means may be provided in the form of one or more coiled springs. As such, it is appreciated that this form of intermediate mechanism provides a relatively simple design solution.

In an alternative arrangement, the intermediate mechanism may comprise: an inlet port that is configured to allow fluid communication between a secondary piston linked to said sleeve and the environment outside the dump bailer; a port closure member that is arranged to move from a default closed position, in which the member blocks the fluid communication between the secondary piston and the outside environment, and an open position, in which fluids within the downhole target region can act on the secondary piston; and wherein the piston operated by the focused stream of gas opens the port closure member.

It is appreciated that, because this alternative form of intermediate mechanism employs the pressure of the well fluid to work the sleeve, the overall size of the dump bailer's sleeve actuation mechanism can be reduced as there is no need to house a potential energy store (e.g. coiled spring) within the dump bailer. This can either allow the overall size of the dump bailer to be reduced or the relative size of the payload chamber to be increased to accommodate more payload material.

Preferably the sleeve may be maintained in the closed position as a default by the action of resilient biasing means and/or a shear pin assembly. In this way the contents can be retained within the elongate payload chamber by the sleeve until the dump bailer has been delivered to the target region and its gas-generated chemical reaction mixture has been initiated.

Although it is not considered essential to the dump bailer of the present invention in general, preferably the gas-generating chemical reaction mixture is also capable of generating sufficient heat to melt the contents of the elongate payload chamber.

The gas-generating chemical reaction mixture may preferably comprise: between 7.5 and 35.5% by weight of an oxidizable metal; between 64.0 and 92.0% by weight of an oxidizing reagent; and between 0.5 and 30.0% by weight of said gas generating additive.

Further preferably, the gas generating additive may be a metal carbonate that is preferably selected from a group consisting of $BaCO_3$, $BeCO_3$, $ZnCO_3$, $MgCO_3$, Ca $Mg(CO_3)_2$, $CaCO_3$, $SrCO_3$, $MnCO_3$, $Fe(CO_3)_2$ and combinations thereof.

Additionally or alternatively, the oxidizable metal is preferably selected from a group consisting of Al, B, Mg, Mn, Ti, AlSi and AlMg; and/or the oxidizing reagent is selected from a group consisting of CuO, $Cu_2O$, $Cr_2O_3$, $WO_3$, $Fe_2O_3$, $Fe_3O_4$, $MnO_2$, $Bi_2O_3$, $MoO_3$ and $PbO_2$.

By selected a chemical reaction mixture that generates both gas and significant quantities of heat it is possible to use the mixture's reaction to both open the dump bailer (thereby deploying the contents of the elongate payload chamber) and heat the payload material within the downhole target region.

It is envisaged that the payload material being delivered by the dump bailer can be selected to carry out different downhole operations; such as the formation of alloy plug/seals within the target region or the clearance/removal of well structures from within the target region.

It envisaged that the dump bailer of the present invention could be employed to deliver a range of other payload materials to a downhole target region without departing from the scope of the present invention, said materials include: cement, resin, drilling mud, sand or gravel, acids and other stimulation fluids.

However, preferably the payload material contained within the elongate payload chamber comprises a plurality of alloy beads or pellets. In such embodiments, the gas-generating chemical reaction mixture may preferably be capable of generating sufficient heat to melt the alloy bead or pellets deployed into the target region. In this way the dump bailer can be used in operations relating to the formation of an alloy plug/seal within the downhole target region.

In an alternative preferred arrangement, the payload material contained within the elongate payload chamber may be a flowable thermite mixture that is in the form of a powder, a paste, a gel or a liquid.

In such embodiments, the gas-generating chemical reaction mixture may be capable of generating sufficient heat to initiate the exothermic reaction of the flowable thermite mixture deployed into the target region.

In this way the dump bailer can be used in the clearance/removal of well structures (such as an alloy plug or seal; a well tubing/casing; previously deployed well tools; cabling, tubing and other lines deployed within an oil/gas well).

It is envisaged that the dump bailer of the present invention may form part of a larger downhole tool assembly that comprises additional functional components that enable the assembly carry out a desired downhole operation.

For example, in the case of an operation relating to the clearance/removal of a well structure from within a target region, the assembly may also be equipped with a second heating tool and/or a perforating tool in addition to the dump bailer of the present invention.

In a further example, relating to the formation of any alloy plug within a downhole target region, the assembly may additionally be equipped with a second heating tool and/or an expandable base at its leading end to minimise the run off of the alloy deployed by the dump bailer.

In addition to the above described apparatus, the present invention also provides a method of forming an alloy plug/seal within a target region of an oil/gas well, said method comprising: providing a dump bailer in accordance with the present invention with a quantity of alloy beads or pellets within the elongate payload chamber; delivering the dump bailer downhole; triggering the chemical reaction of the gas-generating chemical reaction mixture within the dump bailer so as deploy the alloy into the target region; and melting the alloy before allowing it to cool and form the plug/seal.

Preferably the deployed alloy may be melted, at least in part, by heat generated by the gas-generating chemical reaction mixture.

Preferably the dump bailer may be delivered downhole as part of a downhole tool assembly that also comprises an additional heating tool and the additional heating tool generates heat to melt the alloy in the target region.

Further, the present invention also provides a method of removing or clearing a well structure from a target region of an oil/gas well, said method comprising: providing a dump bailer in accordance with the present invention with a quantity of a flowable thermite mixture within the elongate payload chamber; delivering the dump bailer downhole; triggering the chemical reaction of the gas-generating chemical reaction mixture within the dump bailer so as to deploy the flowable thermite mixture into the target region; and initiating an exothermic reaction in the flowable thermite mixture to generate heat that removes/clears the well structure.

Preferably the exothermic reaction of the deployed thermite mixture may be initiated, at least in part, by heat generated by the gas-generating chemical reaction mixture.

Preferably the dump bailer may be delivered downhole as part of a downhole tool assembly that also comprises an additional heating tool and the additional heating tool generates heat to initiate the exothermic reaction of the deployed thermite mixture in the target region.

Although the dump bailer described above is primarily intended for the delivery of payload materials (e.g. alloy shot, chemical reaction heat source mixtures) to a downhole target region, and in particular an oil/gas well, it is envisaged that the gas actuated control mechanism could also be employed on a dump bailer that is used to retrieve materials from within a downhole target region.

In view of this, the present invention also provides for the use of the dump bailer of the present invention in the retrieval of material (e.g. such as debris) from a downhole target region within an oil/gas well.

BRIEF DESCRIPTION OF THE DRAWINGS

The present invention will now be described with reference to the preferred embodiments shown in the drawings, wherein.

DETAILED DESCRIPTION OF THE PREFERRED EMBODIMENTS

Figure 1A:
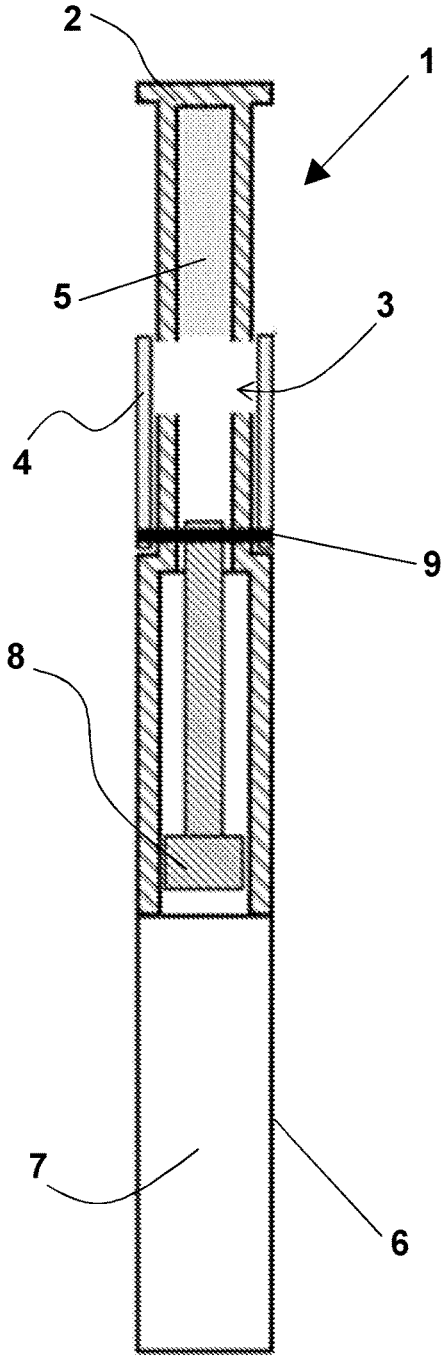
FIGS. 1*a* and 1*b* shows a diagrammatic representation of a preferred embodiment of a directly actuated dump bailer in accordance with the present invention in both the open and closed positions.

As noted above, the dump bailer of the present invention could be employed in both the deployment of material to a downhole target region and also in the retrieval of material from a downhole target region.

However the main application contemplated by the inventors is the use of the dump bailer to deploy materials to a downhole target region. As such, the preferred embodiments shown in the Figures are both dump bailers that are primarily configured to deliver a payload material to a downhole target region upon activation by gas generated by a quantity of gas-generating chemical reaction mixture housed within the dump bailer.

Unless otherwise stated it should be appreciated that the dump bailers of the present invention are to be constructed from materials typically used in the manufacture of existing dump bailer tools used in downhole environments such as oil/gas wells.

Before describing the dump bailers of the present invention in any detail, it is considered appropriate to consider the preferred embodiments of the gas-generating chemical reaction mixture used in accordance with the present invention, which are thermite based.

In general thermite is a pyrotechnic composition of a metal powder and a metal oxide that produces an exothermic oxidation-reduction reaction known as a thermite reaction.

Although a range of powdered metals can be used, Aluminium (Al) is a preferred choice for the thermite mixtures used in the chemical heaters of the present invention. Other preferred choices include Aluminium Silicon (AlSi), Magnesium Aluminium (AlMg), Boron (B), Magnesium (Mg), Manganese (Mn) and Titanium (Ti).

With regards to the metal oxide, cupric oxide (CuO) is considered particularly preferable for the thermite mixtures used in the present invention. However other suitable examples include $Cu_2O$, $Cr_2O_3$, $WO_3$, $Fe_2O_3$, $Fe_3O_4$, $MnO_2$, $Bi_2O_3$, $MoO_3$ and $PbO_2$.

It is envisaged that a range of gas generating additives could be introduced into the core thermite mixture (i.e. the metal powder and the metal oxide) provided they evolve gas during the thermite reaction.

However, metal carbonates are considered particularly preferable because they degrade during the thermite reaction to produce Carbon Monoxide (CO) and Carbon Dioxide ($CO_2$) gas. These gases are considered optimum because they do not solidify within the temperature ranges typically found downhole and therefore they do not create residues in the downhole target region that might have a negative impact on the seals formed between the alloy and the downhole structures (i.e. well tubing/casing).

Examples of preferred metal carbonates include $BaCO_3$, $BeCO_3$, $ZnCO_3$, $MgCO_3$, Ca $Mg(CO_3)_2$, $CaCO_3$, $SrCO_3$, $MnCO_3$, $Fe(CO_3)_2$.

It will be appreciated that the above identified components (i.e. metal powder, metal oxide, gas generating additive) can be combined in a variety of ways to achieved a thermite based heat source that is capable of generating both heat and gas during an exothermic reaction.

However, preferably the gas generating thermite based heat source employed in the heater of the downhole tool assembly of the present invention comprises the following composition:

- between 7.5 and 35.5% by weight of an oxidizable metal (i.e. metal powder);
- between 64.0 and 92.0% by weight of an oxidizing reagent (i.e. metal oxide);
- between 0.5 and 30.0% by weight of said gas generating additive.

A preferred example of the gas-generating chemical reaction mixture used in the dump bailers of the present invention comprises: Al 18.4% by weight; CuO 81.6% by weight; $CaCO_3$ 10% by weight.

Figure 1B:
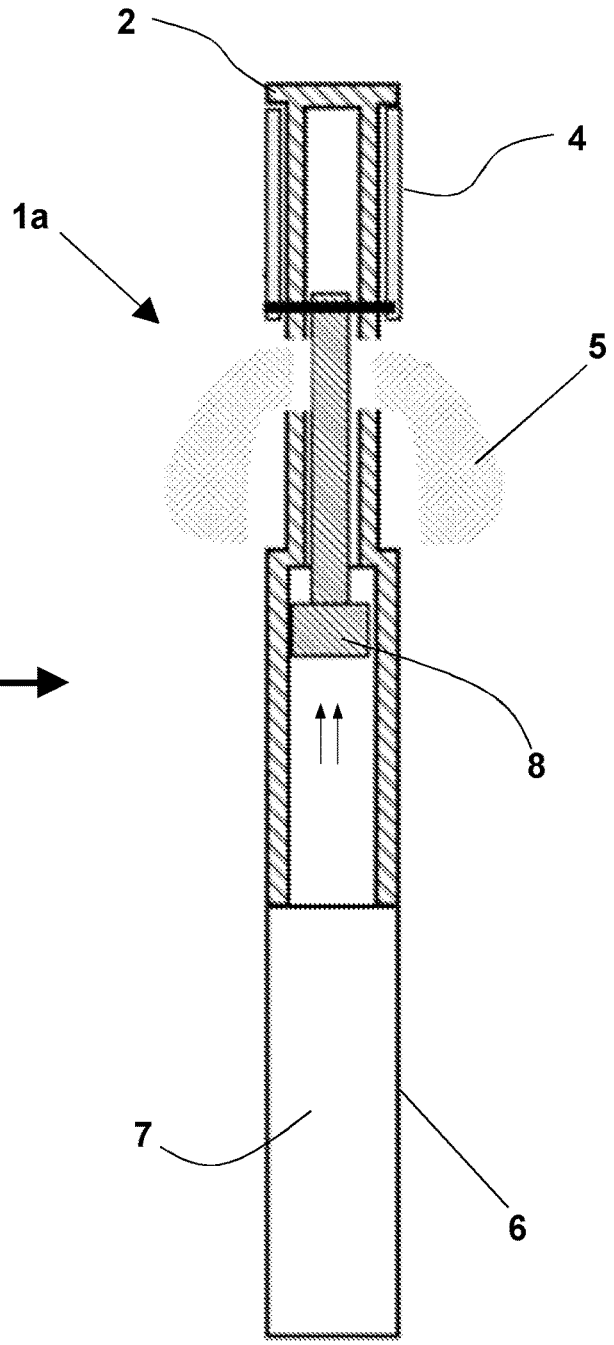

Turning now to FIGS. 1*a* and 1*b*, a first preferred embodiment is shown in which the opening of the dump bailer 1 is facilitated by the direct action of gas generated by the on-board gas-generating chemical reaction mixture 7.

The remaining Figures relate to an alternative preferred embodiment of the dump bailer 10 of the present invention, wherein the dump bailer is opened by the indirect action of the gas generated by the on-board gas-generating chemical reaction mixture 17.

FIG. 1*a* shows the preferred dump bailer 1 in the closed position and FIG. 1*b* the same preferred dump bailer 1 in the open position 1*b*.

The dump bailer 1 comprises an elongate payload chamber 2 with a pair of discharge ports 3. With that said, it is envisaged that one or more discharge ports could be provided in the payload chamber without departing from the general scope of the present invention.

In those embodiments where multiple discharge ports are provided, it is considered preferable that they should be evenly distributed around the lower region of the payload chamber.

This is because the dump bailer of the present invention to deploys its payload material primarily under the force of gravity. It is appreciated that said one or more discharge ports 3 must be located in the lowest region of the payload chamber 2 so as to minimise the among of material left in the chamber once the discharge ports have been opened.

When the dump bailer 1 is in the closed position, the contents of the payload chamber 2 are prevented from flowing out of the discharge ports 3 by the obstructing presence of the sleeve 4. In the open position the sleeve 4 of the dump bailer 1*a* is moved out of the way of the discharge ports 3 and the payload material 5 is free to flow out of the dump bailer 1*a* into the surrounding environment.

The elongate payload chamber 2 is connected to the top of sealed chamber 6 via an intermediate chamber, within which is provided a piston 8 that is operatively linked to the sleeve 4.

The sealed chamber 6, which contains a gas-generating chemical reaction mixture 7, is provided with a port that this configured to eject a focused stream of gas onto the piston 8 mounted within the intermediate chamber.

In this way gas generated by the gas-generating chemical reaction mixture held within the sealed chamber 6 actuates the movement of the piston 8 upwards away from the sealed chamber 6 and towards the payload chamber 2. This action of the piston 8 causes the linked sleeve 4 to also move upwards, which acts to uncover the discharge ports 3.

In order to ensure the efficient transfer of forces using the gas the payload chamber 2, the intermediate chamber and the sealed chamber 6 are connected together with a gas tight seal. It is envisaged that the gas tight relationship could be achieved in a number of ways, which include a screw thread fit and/or a welded joint.

In addition, although not shown, it will be appreciated that multiple seals (e.g. elastomeric seals) could be provided on the outer diameter of the piston 8 and/or on the inner diameter of the payload chamber 2, the intermediate chamber and the sealed chamber 6.

The formation of the gas tight seal between the various components of the dump bailer 1 ensures that any gas generated by the exothermic reaction of the gas generating chemical reaction mixture (e.g. thermite mixture) 7 enclosed within the sealed chamber 6 can be harnessed and used to act on the piston 8 that directly operates the sleeve and allows the payload material (e.g. alloy beads or pellets, or flowable thermite mixture) held within the payload chamber 2 to be deployed into a downhole target region.

It is envisaged that the sleeve 4 is retained in the closed position by default, preferably under the action of a resilient biasing means or a shear pin assembly (not shown).

However, upon initiation of the gas generating chemical reaction mixture 7 in the sealed chamber 6, and the subsequent generation of gas, the movement of the piston 8 and the sleeve 4 overcomes the mechanisms used to hold the sleeve in the default position and the ports 3 are exposed to allow the alloy to exit the dump bailer.

Although a range of mechanisms may be employed to initiate the chemical reaction, it is envisaged that in those arrangements where the dump bailer is delivered downhole using wireline as the delivery support, an electrical signal may be used to trigger the initiation of the gas generating chemical reaction mixture 7.

As noted above, FIG. 2 shows an alternative preferred embodiment of the dump bailer 10 of the present invention, which, in contrast to the dump bailer 1 shown in FIGS. 1*a* and 1*b*, is indirectly actuated by the gas generated by the gas generating chemical mixture housed within the dump bailer.

The dump bailer 10 is provided with a payload chamber 11 at the trailing end thereof. This portion is referred to as the 'trailing end' because it is the portion that enters the well last when the dump bailer 10 is delivered downhole using a suitable delivery support (e.g. wireline, coiled tubing, etc.).

Figure 2:
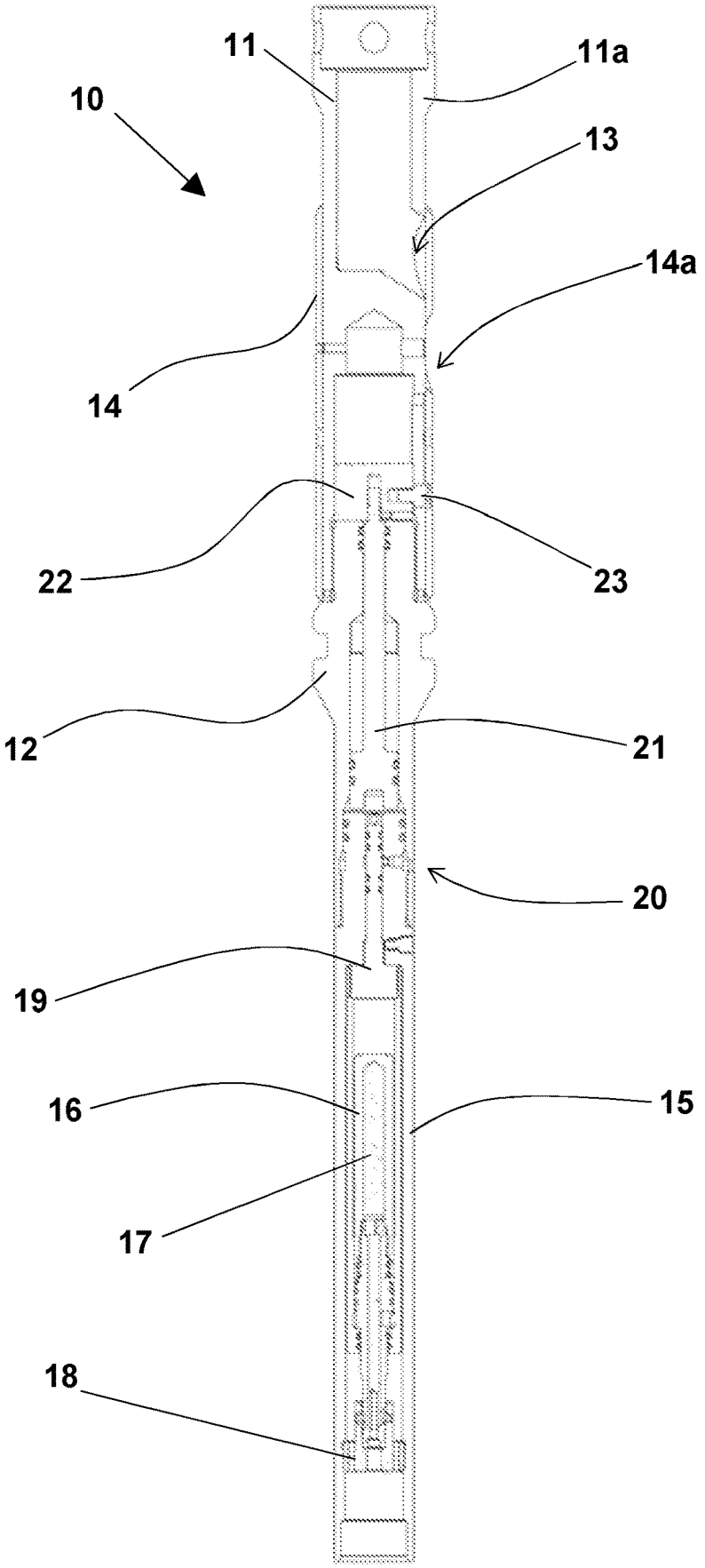
FIG. 2 shows a preferred embodiment of an indirectly actuated dump bailer in accordance with the present invention.

It will be appreciated that the payload chamber 11 is only shown in part and that a larger storage chamber would extend upwards from the portion shown in FIG. 2. In this regard it is envisaged that the actual length of the payload chamber 11 selected would depend to a certain extent by the quantity of payload material being delivered downhole.

It is envisaged that provided the payload chamber 11 is elongate in nature, and preferably tubular, its cross-sectional shape of the chamber could be selected from a range of possibilities, which include circular, oval and polygonal (e.g. hexagonal).

The lowest portion of the payload chamber 11 is provided with a discharge port 13 through which the contents of the payload chamber 11 can exit under the force of gravity. However, when the dump bailer is in the closed position (as is shown in FIG. 2) a sleeve 14 acts to cover the discharge port 13, thereby preventing the contents of the payload chamber from escaping into the surrounding environment.

The sleeve actuation mechanism 15 of the dump bailer 10 is positioned downhole of the payload chamber 11 and the sleeve 14 at a location towards the leading end (i.e. the end that enters the well first) of the dump bailer. The sleeve actuation mechanism 15 achieves the operation of the sleeve 14 by way of a conduit that extends from along the length of the dump bailer 10 between the trailing and leading ends thereof.

The sleeve actuation mechanism 15 of the dump bailer 10 comprises a sealed chamber 16, a primary piston assembly 19 and a secondary piston assembly 21 and 22, all of which are located within the conduit.

The primary piston assembly 19 and the secondary piston assembly 21, 22 are both arranged so as to be slidable within the conduit. In contrast the sealed chamber 16, which contains a quantity of gas-generating chemical reaction mixture 17, is held in a fixed position by way of a stop sub 18.

The stop sub 18, which may be screwed or welded into position within the conduit of the dump bailer, anchors the sealed chamber 16 to the inner walls of the dump bailer so that it cannot move.

Multiple elastomeric seals are provided on the conduit walls, the pistons and on the sealed chamber 16 in order to separate the conduit into distinct chambers. The arrangement of the seals will be described in more detail below with reference to FIGS. 3*a*, 3*b*, 4*a* and 4*b*.

The sleeve 14 is attached to the upper head 22 of the secondary piston 21 by way of a mechanical fixing (e.g. a bolt or a grub screw), such that when the secondary piston 21 is urged upwards, the sleeve 14 is also urged upwards.

In addition, a collar portion 12 is provided at the midpoint of the dump bailer 10 between the payload chamber 11 and the sealed chamber 16. The collar portion 12 is shaped so as to extend beyond the outer diameter of the other parts of the dump bailer. In this way the collar acts to protect the other parts of the dump bailer (such as the sleeve 14) from being damaged by the surrounding well tubing/casing/rock formation when the dump bailer is delivered downhole.

In addition, the collar 12 is provided with an annular recess 12*a*, which enables the dump bailer to be handled by the tool handling machinery located at the well head and also supported by a 'C' ring resting on the floor when the payload material is loaded into the dump bailer.

In contrast to the dump bailer shown in FIGS. 1*a* and 1*b*, where the gas generated within the dump bailer 1 acts directly on a piston 8 that is attached to the sleeve 4 that covers the discharge ports 3, the dump bailer 10 shown in FIG. 2 (and FIGS. 3*a*, 3*b*, 4*a*, 4*b*) uses the gas generated within the dump bailer 10 to indirectly operate the secondary piston 21 that is attached to the sleeve 14.

The operation of the preferred embodiment of the indirectly actuated dump bailer of the present invention will now be described with reference to FIGS. 3*a* and 3*b*, which show simplified views of the trailing end of the dump bailer in the closed and open positions respectively, and FIGS. 4*a* and 4*b*, which show simplified views of the leading end of the dump bailer 10 in the closed and open positions respectively.

Figure 3A:
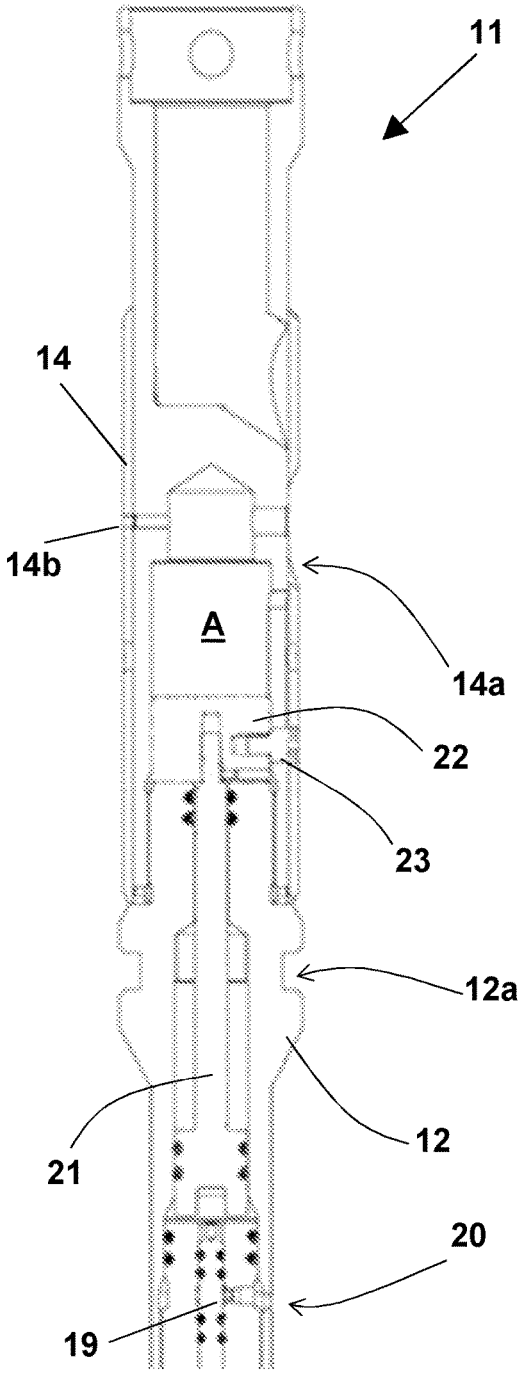
FIGS. 3*a* and 3*b* show simplified views of the upper portion of the dump bailer shown in FIG. 2 in the closed and open positions respectively.
Figure 4A:
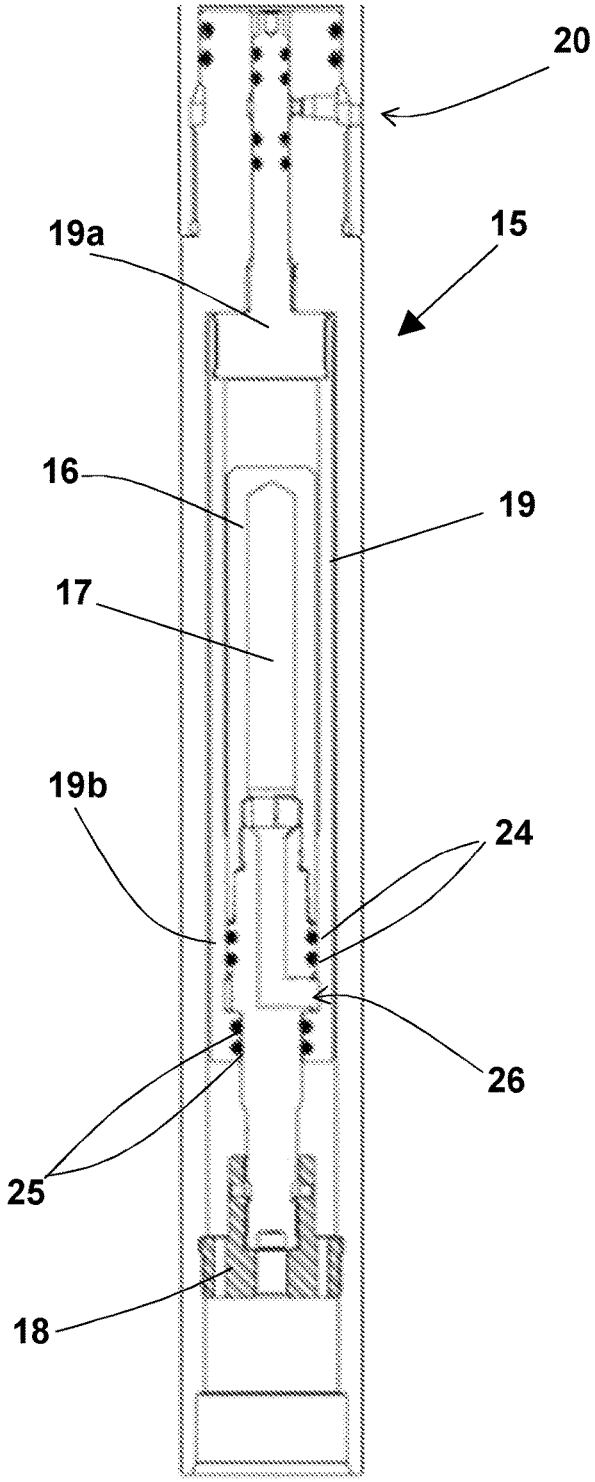
FIGS. 4*a* and 4*b* show simplified views of the lower portion of the dump bailer shown in FIG. 2 in the closed and open positions respectively.

FIG. 3*a* shows the payload chamber 11 in the closed position, wherein the sleeve 14 covers the discharge port 13 of the payload chamber 11. In this arrangement, the sleeve 14 prevents the passage of any materials held within the chamber through the discharge port 13.

The closed position is considered to be the default position of the dump bailer 10 because it ensures that the payload is not deployed until the dump bailer is triggered to do so.

In order to maintain the sleeve 14 in this default position, the collar 12 acts to support the bottom of the sleeve 14 to prevent it sliding further down the dump bailer 10 under gravity.

In addition, the sleeve 14 is prevented from travelling up the dump bailer unintentionally by the action of a shear pin (not shown), which is inserted through sleeve aperture 14*b* and into the payload chamber 11. It is appreciated that additionally, or alternatively, resilient biasing means may be employed to retain the sleeve 14 in the default closed position.

Figure 3B:
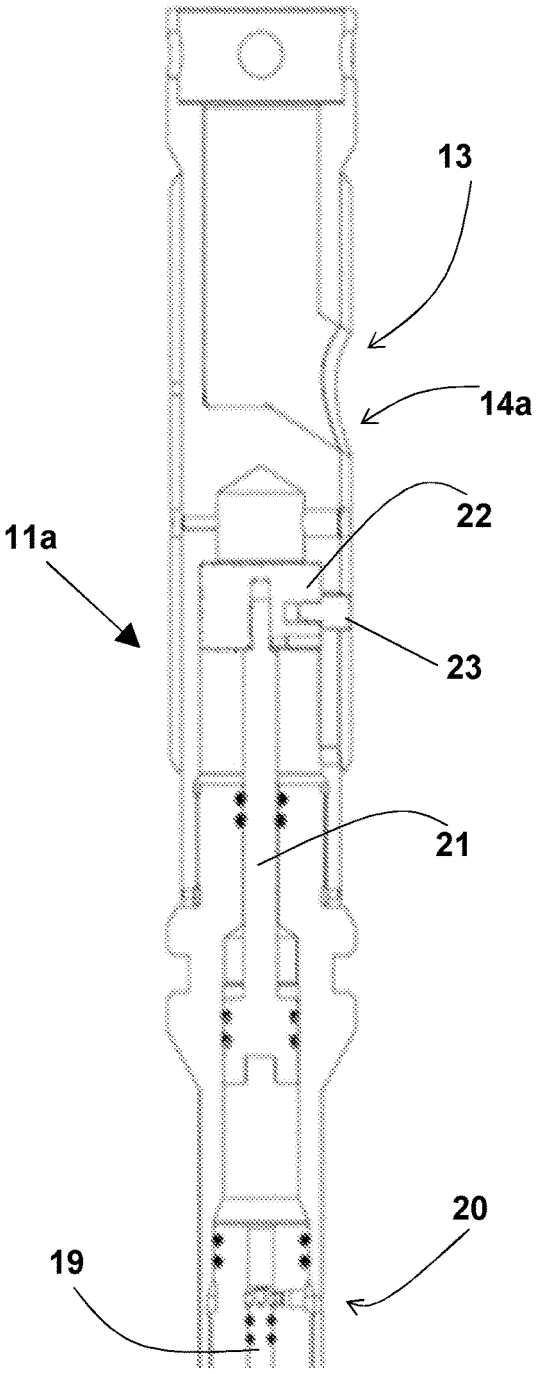

In order to actuate the movement of the sleeve 14 from the closed position to the open position, as is shown in FIG. 3*b*, the sleeve is mechanically linked to the piston head 22 of the secondary piston 21 by way of a mechanical fixing 23 (e.g. a grub screw or bolt). The mechanical fixing 23 ensures that the secondary piston 21 and the sleeve 14 move as one.

It will be appreciated that, although not shown, a slot or channel will be provided in the side of the dump bailer to allow the mechanical fixing 23 to travel up and down relative to the payload chamber 11 under the action of the secondary piston 21.

The movement of the secondary piston 21 within the conduit of the dump bailer 10 is actuated by the action of well fluids entering the conduit through well fluid port 20.

In order to maximise the actuating effect of the ingressing well fluid on the secondary piston 21, the chamber A above the piston head 22 contains air that is at atmospheric pressure (approximately 14.7 psi). In this way, as the air within chamber A is at a lower pressure than the well fluid in the downhole target region (which can reach 6000 psi) the net force acting on the secondary piston 21 is more than sufficient to overcome any retaining mechanisms (e.g. shear pins or resilient biasing means such as springs) to urge the sleeve from the closed position to the open position.

Of course, until the well fluid port 20 open, well fluids cannot enter the conduit of the dump bailer and the secondary piston remains in the default position associated with the closed position of the sleeve 14.

When the dump bailer 10 is in the closed position the passage of well fluids through the well fluid port 20 to the secondary piston 21 is prevented by the presence of the primary piston assembly 19, which essentially blocks the fluid pathway between the well fluid port 20 and the secondary piston 21.

The operation of the primary piston assembly 19, and thus the mechanism associated with triggering the transition of the dump bailer from the closed position to the open position, will now be described with reference to FIGS. 4*a* and 4*b*, which show the leading end of the dump bailer in the closed and open states respectively.

The primary piston assembly 19 is made up of two main portions. The top portion 19*a*, which acts to block the fluid pathway between the well fluid port 20 and the secondary piston 21, and the bottom portion 19*b*, which encloses the sealed chamber 16 that contains the gas generating chemical reaction mixture 17.

As noted above, the primary piston assembly 19 is able to slide up and down relative to the sealed chamber 16 within the conduit. However, with that said, in order to ensure that the top portion 19*a* of the piston continues to block the fluid pathway between the well fluid port 20 and the secondary piston 21, resilient biasing means are provided between the stop sub 18 and the base of bottom portion 19*b*.

Preferably the resilient biasing means may be provided in the form of a coiled spring (not shown). Alternatively, or indeed additionally, shear pins may be employed to help retain the primary piston in the default closed position until the gas pressure within the dump bailer reaches a predetermined level.

Elastomeric seals 24, mounted on the outer walls of the sealed chamber 16, and elastomeric seals 25, mounted on the inner walls of the bottom portion 19*b* of the primary piston assembly 19, combine to define a chamber into which the outlet port of the sealing chamber 16 feeds.

Following the initiation of the gas generating chemical reaction mixture 17 that is housed within the sealed chamber 16, which it will be envisaged may be achieved by way of an electrical signal sent downhole via a wireline, the only egress route available for the gas is via the ejection port 26.

Consequently, the pressurised gas generated within the sealed chamber 16 is focused into the chamber that is defined between the elastomeric seals 24 and 25. It will be appreciated that, as the sealed chamber is fixed in position, the only pressure release available as the gas generated within the sealed chamber 16 builds up is for the primary piston assembly 19 to move downwards (whereby the chamber defined by the seals 24, 25 is made bigger).

The force of the gas urges the piston downwards with a force that is great enough to overcome the resilient biasing means used to urge the primary piston assembly 19 towards the default position.

Figure 4B:
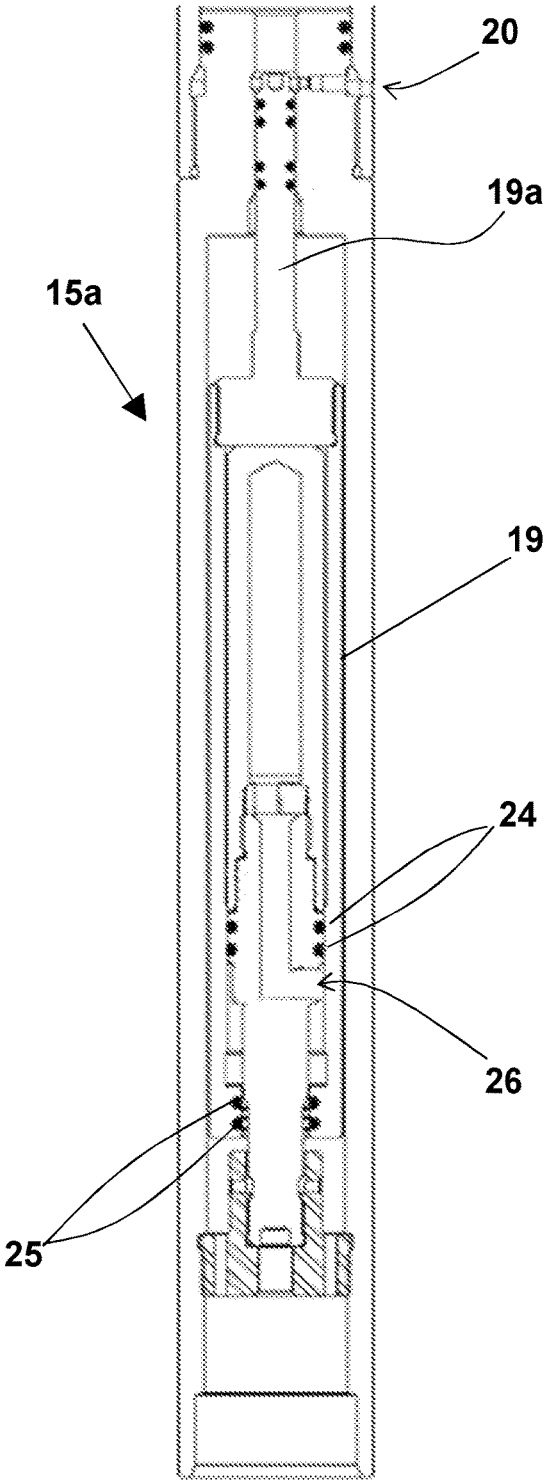

As will be appreciated from FIG. 4*b*, the downwards movement of the primary piston assembly 19 towards the stop sub 18 causes the top portion 19*a* of the piston to retreat out of the fluid pathway between the well fluid port 20 and the secondary piston 21. This in turn allows the ingress of the well fluids that, as described above, overcome the biasing forces/shear pin holding the sleeve in the closed position and urge the secondary piston 21 and the linked sleeve 14 upwards.

The sleeve 14 slides upwards until it abuts against a stop 11*a* that projects radially outwards from the payload chamber 11, at which point the sleeve port 14*a* and the discharge port 13 align. Once the ports 13, 14*a* are aligned the contents of the payload chamber are free to leave the dump bailer under the action of gravity.

As noted above, it is envisaged that the type of payload material deployed by the dump bailer of the present invention may be selected on the basis of the type of downhole operation that is to be carried out.

For instance, in the case of a downhole operation to deploy an alloy plug or seal within a target region of an oil/gas well, the dump bailer may be loaded with a suitable alloy (e.g. a bismuth based alloy).

Whereas in the case of a downhole operation to clear or remove a well structure (such as well casing/tubing for example) from a target region of an oil/gas well, the dump bailer may be loaded with a flowable chemical reaction heat mixture (e.g. thermite).

In both operations it is contemplated the dump bailer of the present invention (including those shown in the Figures) could form part of a larger downhole tool assembly that also comprises one or more additional heating tools (chemical or electrical). In this way the additional heating tool(s) could be used to melt the alloy or initiate the flowable chemical reaction heat mixture.

However, with that said, it is also envisaged that the gas generating chemical reaction mixture housed within the dump bailer may, at least in part, be used to heat the target region and melt/initiate the payload material once it has been deployed by the dump bailer.

The invention claimed is:

1. A gas-actuated dump bailer for use in the delivery of a payload material to a downhole target region, said dump bailer comprising: an elongate payload chamber having a discharge port, via which the contents of the chamber can be deployed into said target region under the force of gravity; a sleeve that is mounted relative to the payload chamber so as to be moveable between a closed position, in which said discharge port is covered by the sleeve, and an open position, in which said discharge port is exposed by the sleeve; a sleeve actuation mechanism arranged to move the sleeve between the open and closed positions by the action of a piston which extends above or below the sleeve and that is linked, either directly or indirectly, to said sleeve, wherein said mechanism comprises a sealed chamber containing a gas-generating chemical reaction mixture; and wherein the sealed chamber has a pressure port that is configured to eject a focused stream of gas that operates the piston and moves the sleeve between the closed position and the open position.

2. The dump bailer of claim 1, wherein the sleeve has a corresponding port that aligns with the discharge port of the elongate payload chamber when the sleeve is in the open position.

3. The dump bailer of claim 1, wherein the elongate payload chamber is tubular-shaped.

4. The dump bailer of claim 1, wherein the sleeve is slidably mounted relative to the payload chamber.

5. The dump bailer of claim 1, wherein the piston operated by the focused stream of gas ejected from the sealed chamber of the sleeve actuation mechanism acts directly on the sleeve.

6. The dump bailer of claim 1, wherein the piston operated by the focused stream of gas ejected from the sealed chamber acts on the sleeve indirectly via an intermediate mechanism.

7. The dump bailer of claim 6, wherein the intermediate mechanism comprises a mechanical potential energy store in the form of resilient biasing means held in an elastically deformed state by a latch mechanism; and whereby the piston operated by the focused stream of gas frees the latch mechanism and releases the resilient biasing means, which act to move the sleeve between the closed position and the open position.

8. The dump bailer of claim 6, wherein the intermediate mechanism comprises:

an inlet port that is configured allow fluid communication between a secondary piston linked to said sleeve and the environment outside the dump bailer;

a port closure member that is arranged to move from a default closed position, in which the member blocks the fluid communication between the secondary piston and the outside environment, and an open position, in which fluids within the downhole target region can act on the secondary piston; and wherein the piston operated by the focused stream of gas opens the port closure member.

9. The dump bailer of claim 1, wherein the sleeve is maintained in the closed position as a default by the action of resilient biasing means and/or a shear pin assembly.

10. The dump bailer of claim 1, wherein gas-generating chemical reaction mixture is also capable of generating sufficient heat to melt the contents of the elongate payload chamber.

11. The dump bailer of claim 1, wherein the gas-generating chemical reaction mixture comprises:

between 7.5 and 35.5% by weight of an oxidizable metal;

between 64.0 and 92.0% by weight of an oxidizing reagent; and between 0.5 and 30.0% by weight of said gas generating additive.

12. The dump bailer of claim 11, wherein said gas generating additive is a metal carbonate that is preferably selected from a group consisting of $BaCO_3$, $BeCO_3$, $ZnCO_3$, $MgCO_3$, Ca $Mg(CO_3)_2$, $CaCO_3$, $SrCO_3$, $MnCO_3$, $Fe(CO_3)_2$ and combinations thereof.

13. The dump bailer of claim 1, wherein:

the oxidizable metal is selected from a group consisting of Al, B, Mg, Mn, Ti, AlSi and AlMg; and the oxidizing reagent is selected from a group consisting of CuO, $Cu_2O$, $Cr_2O_3$, $WO_3$, $Fe_2O_3$, $Fe_3O_4$, $MnO_2$, $Bi_2O_3$, $MoO_3$ and $PbO_2$.

14. The dump bailer of claim 1, wherein the payload material contained within the elongate payload chamber comprises a plurality of alloy beads or pellets.

15. The dump bailer of claim 14, wherein the gas-generating chemical reaction mixture is capable of generating sufficient heat to melt the alloy bead or pellets deployed into the target region.

16. The dump bailer of claim 1, wherein the payload material contained within the elongate payload chamber is a flowable thermite mixture, that is in the form of a powder, a paste, a gel or a liquid.

17. The dump bailer of claim 16, wherein the gas-generating chemical reaction mixture is capable of generating sufficient heat to initiate an exothermic reaction in the flowable thermite mixture deployed into the target region.

18. A downhole tool assembly comprising the dump bailer of claim 1.

19. The downhole tool assembly of claim 18, wherein the assembly further comprises an additional heating tool arranged downhole of the dump bailer.

20. A method of forming an alloy plug/seal within a target region of an oil/gas well, said method comprising:

providing a dump bailer in accordance with any one of claims 1 to 13 with a quantity of alloy beads or pellets within the elongate payload chamber;

delivering the dump bailer downhole;

triggering the chemical reaction of the gas-generating chemical reaction mixture within the dump bailer so as deploy the alloy into the target region; and melting the alloy before allowing it to cool and form a plug/seal.

21. The method of claim 20, wherein the deployed alloy is melted, at least in part, by heat generated by the gas-generating chemical reaction mixture.

22. The method of claim 20 or 21, wherein the dump bailer is delivered downhole as part of a downhole tool assembly that also comprises an additional heating tool and the additional heating tool generates heat to melt the alloy in the target region.

23. A method of removing or clearing a well structure from a target region of an oil/gas well, said method comprising:

providing a dump bailer in accordance with any one of claims 1 to 13 with a quantity of a flowable thermite mixture within the elongate payload chamber;

delivering the dump bailer downhole;

triggering the chemical reaction of the gas-generating chemical reaction mixture within the dump bailer so as to deploy the flowable thermite mixture into the target region; and initiating an exothermic reaction in the flowable thermite mixture to generate heat that removes/clears the well structure.

24. The method of claim 23, wherein the exothermic reaction of the deployed thermite mixture is initiated, at least in part, by heat generated by the gas-generating chemical reaction mixture.

25. The method of claim 23, wherein the dump bailer is delivered downhole as part of a downhole tool assembly that also comprises the additional heating tool and the additional heating tool generates heat to initiate an exothermic reaction of the deployed thermite mixture in the target region.

* * * * *